United States Patent [19]

Sekiguchi

[11] 4,402,246

[45] Sep. 6, 1983

[54] TONE QUALITY PRESETTING APPARATUS IN ELECTRONIC MUSICAL INSTRUMENT

[75] Inventor: Tomoaki Sekiguchi, Hamamatsu, Japan

[73] Assignee: Nippon Gakki Seizo Kabushiki Kaisha, Hamamatsu, Japan

[21] Appl. No.: 327,109

[22] Filed: Dec. 3, 1981

[30] Foreign Application Priority Data

Dec. 10, 1980 [JP] Japan ..... 55-175015

[51] Int. Cl.[3] ..... G10H 1/02

[52] U.S. Cl. ..... 84/1.19; 84/345; 84/1.03

[58] Field of Search ..... 84/1.19, 115, 345, 1.24, 84/1.03

[56] References Cited

U.S. PATENT DOCUMENTS 3,926,087 12/1975 Griffis ..... 84/345
4,244,263 1/1981 Deutsch et al. ..... 84/345
4,244,264 1/1981 Fellot ..... 84/345

*Primary Examiner*—F. W. Isen
*Attorney, Agent, or Firm*—Spensley, Horn, Jubas & Lubitz

[57] ABSTRACT

A tone quality presetting apparatus for use in an electronic musical instrument, arranged so that, when preset data of tone quality pattern are recalled from a memory to automatically set contents on tone quality setting members of manually operable setting units so as to establish agreement of the contents with the read-out preset data, the tone generator section of the musical instrument is controlled by the contents of the preset data during the period of time till the contents set on the setting members come to agree with the contents of the preset data, and that subsequent to the establishment of this agreement, the tone generator section is directly controlled by the contents set on the setting members, whereby the automatic setting operation of the setting members does not need to be performed at high speed and also the player is not bothered to pay attention to noises which otherwise would be generated in the setting members during automatic setting of contents thereon, and further that, during the part of operation wherein tone quality pattern is determined based on the contents of the preset data, there is displayed a memory channel of the preset data, which display is extinguished when the contents set on the setting members are altered or modified manually by the player.

11 Claims, 4 Drawing Figures

TONE QUALITY PRESETTING APPARATUS IN ELECTRONIC MUSICAL INSTRUMENT

BACKGROUND OF THE INVENTION (a) Field of the Invention

The present invention relates to an improvement in tone quality presetting apparatus for use in electronic musical instruments, which is of the type arranged so that the tone quality setting units such as rotary switches and variable resistors assigned for setting tone quality patterns such as tone colors and tone effects are constructed so as to be activated through either manipulating means or powered automatic setting means such as electric motors. The pertinent tone quality setting units are automatically set by the motor exactly to the desired contents of the data which have been preset in a memory means of the instrument.

(b) Description of the Prior Art

There has been known a tone quality presetting apparatus for use in an electronic musical instrument, which is of the type arranged so that the tone quality setting units such as rotary switches and variable resistors assigned for setting, for example, tone colors and tone effects are constructed so as to be operable through either one of the manual operating means and automatic setting means including motors for example, so that the player actuates the automatic setting means based on the recalled tone quality data which have been preset in a memory means to thereby automatically set the pertinent tone quality setting units exactly to the contents of the selected preset data, and also that the player can arbitrarily set the respective setting units to any desired tone quality patterns through manual operation during the performance of the electronic musical instrument.

According to the tone quality presetting apparatus of the type described above, there are provided various advantages as mentioned below. That is, a desired tone quality pattern to which the pertinent setting units are to be set since the pattern may be used during the play of the electronic musical instrument is stored in a memory in advance, and such tone quality pattern is recalled at any desired moment during the player's performance, whereby the pertinent respective setting units are set simultaneously to the desired contents of the present memory just by one touch of the player's finger onto the corresponding switch means. Thus, the setting operation is greatly facilitated as compared with the prior type electronic musical instruments and also the respective tone quality patterns can be manually set separately on the individual corresponding setting units. Thus, it is possible for the player to easily carry out any desired modification or alteration of the tone quality patterns even after they have been automatically set and memorized by means of the powered automatic setting units without causing a change in the memorized pattern. Not only that, the tone quality presetting apparatus of this type has the further advantage that the contents which have been automatically set on the respective setting units can be directly noticed by the player simply by looking at the indication of the operating positions of the manipulating members provided on the operating panel of the instrument without requiring any special display means.

It often happens that the tone quality presetting apparatus of the type described above is operated in the midst of a play of the electronic musical instrument. Thus, it becomes necessary for the respective tone quality setting units, whenever any one of the present data stored in the memory is recalled, to instantaneously complete their setting to the contents of the recalled data in good response to the recalling operation. For this reason, the respective setting units require a large driving power for realizing the setting, and concurrently therewith, the tone quality presetting apparatus as a whole will become a complicated large-sized system which is quite expensive. Moreover, the respective setting units have to be driven at a high speed, and this gives rise to the generation of cumbersome noises. In addition, there is the further problem that, in order to materialize a high-speed driving of the respective setting units and their precise positioning, the controlling of such operation becomes very difficult.

SUMMARY OF THE INVENTION

A primary object of the present invention is to provide a tone quality presetting apparatus for use in an electronic musical instrument, arranged so that, when tone quality setting units which can be manually operated also are subjected to automatic setting through recall to any one or ones of the preset tone quality data stored in a memory means, this automatic setting action does not require to be performed at a high speed, and yet the player is not bothered to pay attention to noises which, in the prior art, would be generated during the automatic setting procedure.

A second object of the present invention is to provide a tone quality presetting apparatus of the type as described above, which is arranged so that, when the tone quality setting units are set automatically, the tone generator section is controlled directly by the contents of said preset data until the contents which are to be set on said tone quality setting units establish agreement with said preset data, and upon establishment of such agreement, the tone generator section is then controlled based on the contents of data which have now been set on the tone quality setting units.

A third object of the present invention is to provide a tone quality presetting apparatus of the type as described above, which is arranged so that, when the tone quality pattern is determined based on the recalled preset data of the memory, the designated memory addresses of said preset data are displayed on indicators, and also that this display of the memory addresses are extinguished as the contents of the set data are altered by manual operation of the tone quality setting units.

DETAILED DESCRIPTION OF A PREFERRED EMBODIMENT

Description will hereunder be made of a preferred embodiment of the present invention by referring to the accompanying drawings.

The tone quality presetting apparatus shown in this embodiment is provided with 64 tone quality setting units $U_1$–$U_{64}$ for setting such tone quality patterns as tone color and tone effect. Each of these setting units $U_i$ (i=1, 2, . . . , 64) is provided with: a setting member $SS_i$ (which, in this embodiment, is a rotary switch) which is driven by either the force applied to a manually operable manipulating lever $LV_i$ or the force applied to an electric motor $M_i$ via a clutch $CR_i$; an encoder $EC_i$ for outputting a coded output of this setting member $SS_i$; and a gating circuit $G_i$ which is opened at the time of a state $ST_i$ (which will be described later) assigned to its corresponding setting unit $U_i$ to pass the output of the encoder $EC_i$ therethrough. And, each clutch $CR_i$ and motor $M_i$ are controlled by the respective signals CH, $(A<B)_i$ and $(A>B)_i$ which are loaded on a register $RG_i$ at the time of a state $ST_i$. That is, arrangement is provided so that the clutch $CR_i$ is released when the signal CH is "1" of the binary level, and is connected when this signal CH is "0" of the binary level. Also, arrangement is provided so that the motor $M_i$ is rotated in the direction in which it uplifts the manipulating lever $LV_i$ when the signal $(A<B)_i$ is "1" and also when the signal $(A>B)_i$ is "0"; and this motor $M_i$ is driven in the direction to lower the position of the manipulating lever $LV_i$ when the signal $(A>B)_i$ is "0" and also when the signal $(A<B)_i$ is "1."

Figure 2:
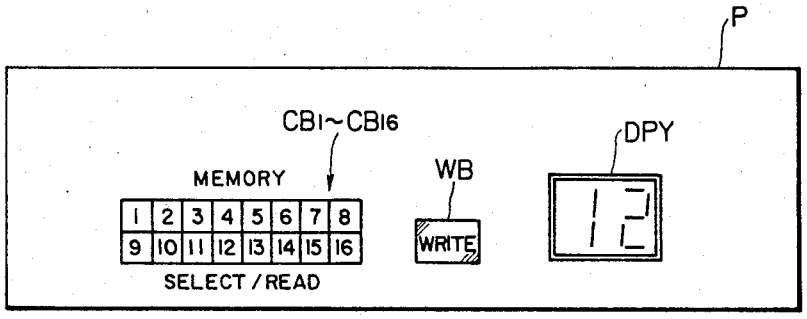
FIG. 2 is a diagrammatic front view showing the operating section of said apparatus.
Figure 3:
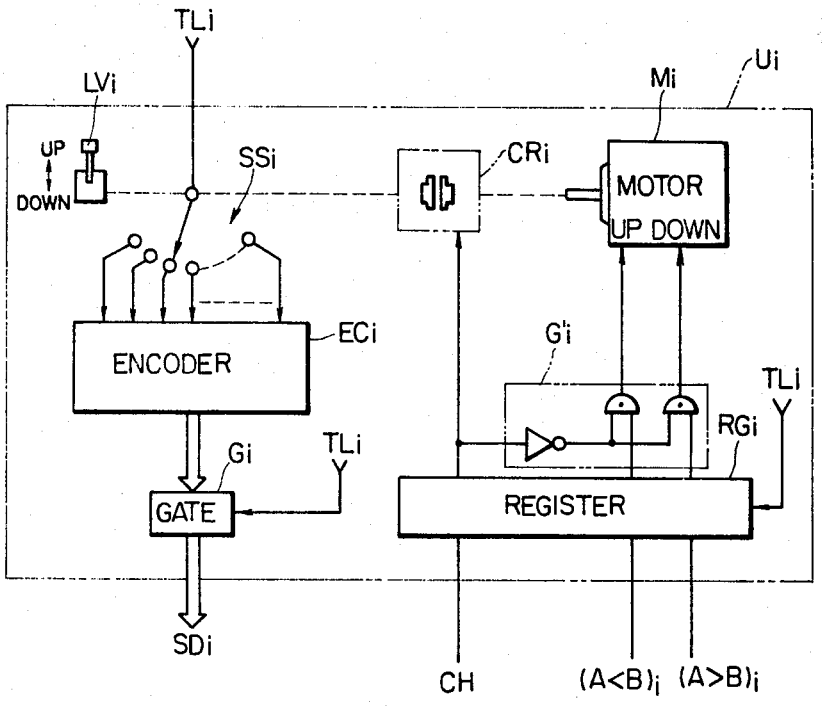
FIG. 3 is a block diagram showing the details of respective setting units of the presetting apparatus.

In the instant embodiment of the tone quality presetting apparatus, there are provided 16 memory channels for storing 16 types of set contents of respective setting members $SS_i$ (i=1, 2, 3, . . . , 64). The designation of these memory channels $CH_1$–$CH_{16}$ is performed by channel-designating switches $CS_1$–$CS_{16}$. To this end, it should be noted that, in order that the contents set on the respective setting members $SS_i$ (i=1, 2, 3, . . . , 64) may be stored in these memory channels, there is employed a write-in switch WS. The operating buttons $CB_1$–$CB_{16}$ of the switches $CS_1$–$CS_{16}$ and the operating button WB of the write-in switch WX are arrayed on an operating panel P which, in turn, is provided on, for example, the front side of the main body of the electronic musical instrument as shown in FIG. 2. On this operating panel P is also disposed an indicator (display means) DPY for indicating a concerned channel number as will be explained later.

Figure 1:
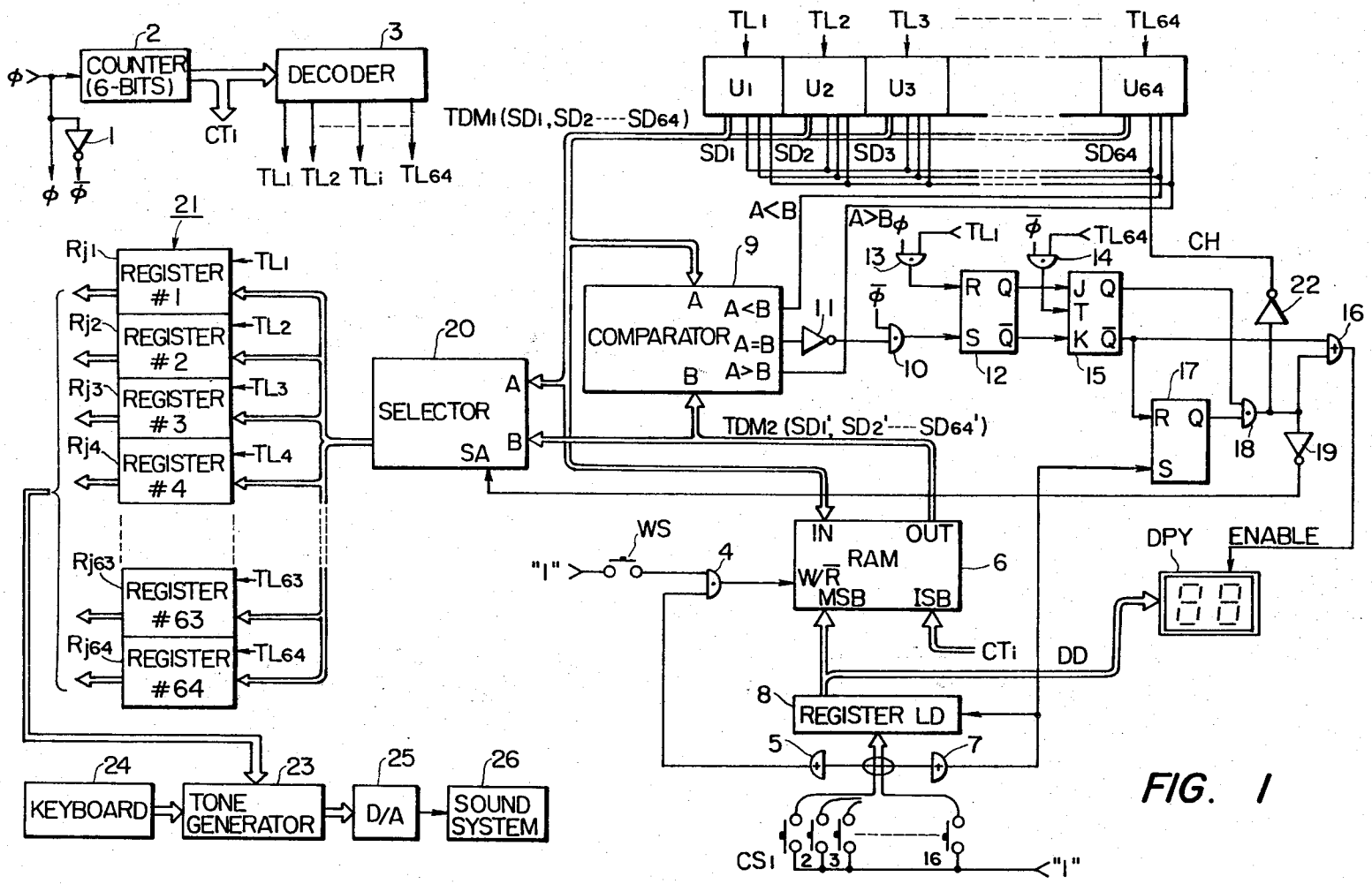
FIG. 1 is a block diagram showing the electrical arrangement of a tone quality presetting apparatus showing an embodiment of the present invention.

Also, the tone quality presetting apparatus of the instant embodiment is synchronously controlled by clock pulses $\phi$ and $\overline{\phi}$ which have a phase difference of 180 degrees relative to each other and which are supplied through two supply lines, and also by timing signals $TL_i$ (i=1, 2, 3, . . . , 64) which are supplied through 64 supply lines. These signals are formed by an inverter 1, a counter 2 and a decoder 3 as shown in FIG. 1.

Description will next be made of the arrangement of the circuitry of the tone quality apparatus of this embodiment in sequential fashion in accordance with the sequential operations of the respective parts thereof.

Let us now assume that the respective setting members $SS_i$ (i=1, 2, 3, . . . , 64) of the respective setting units $U_i$ are in predetermined set conditions. Description will be made of the instance wherein the contents set on a series of these setting members $SS_i$ are stored in desired arbitrary memory channels $CH_N$.

In such instance, the player depresses an operating button $CB_N$ corresponding to a desired memory channel N while the write-in operating button WB shown in FIG. 2 is being depressed. Whereupon, due to said depression of the write-in button WB, the write-in switch WS shown in FIG. 1 is "made," and its output is delivered as "1," whereby enabling an AND gate 4. On the other hand, owing to the depression of the operating button $CB_N$, the channel-designating switch $CS_N$ shown in FIG. 1 is "made," and its output will become "1," and accordingly the output of an OR gate 5 will also become "1." This output "1" of the OR gate 5 is supplied, via an AND gate 4, to a terminal W/R of a RAM (Random Access Memory) 6, whereby this RAM 6 is set to the write-in mode. Also, the outputs of the respective channel-designating switches $CS_1$–$CS_{16}$ are adapted to be supplied to a terminal LD of a register 8 via an OR gate 7. Accordingly, when the output of the channel-designating switch $CS_N$ becomes "1," this output "1" is loaded on the register 8. And, the output of this register 8 is supplied to a terminal MSB of RAM 6. Whereby, a series of those address areas within RAM 6 which correspond to the channels N are designated. Also, because a count output $CT_i$ of the counter 2 is being supplied to a terminal LSB of RAM 6, it will be noted that, within RAM 6, a series of addresses in the abovesaid designated address areas are scanned successively in synchronism with the clock pulse $\phi$, starting at the top-leading one of the addresses.

Figure 4:
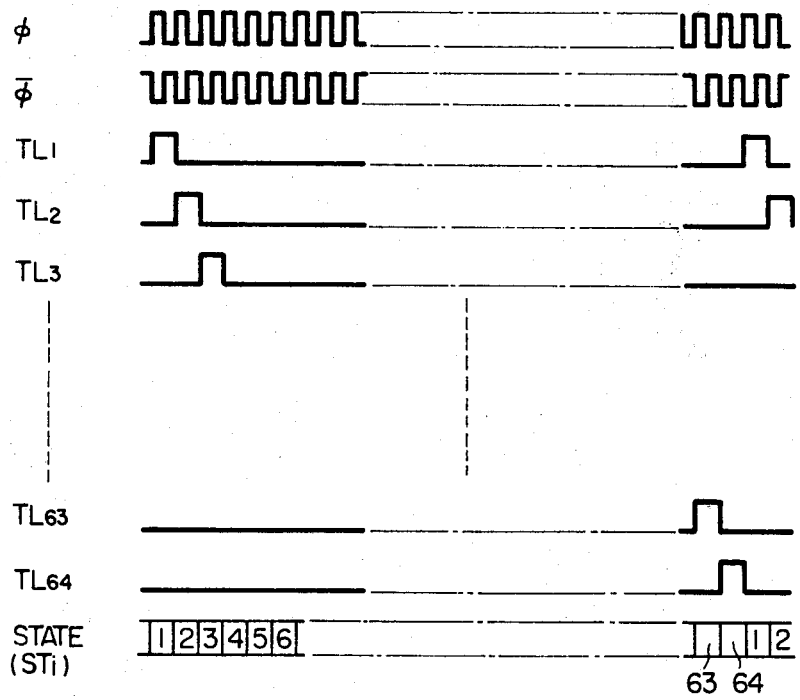
FIG. 4 is a timing chart showing the states of respective timing signals for the operation of the apparatus in FIG. 1.

On the other hand, to the terminal IN of RAM 6 are supplied time division multiplexed signals $TDM_1$ having 1st to 64th states shown in FIG. 4. These 1st to 64th states contain data $SD_1$–$SD_{64}$ indicating the contents set on the setting units $U_1$–$U_{64}$, respectively. Accordingly, data $SD_1$–$SD_{64}$ indicating the contents set on the setting units $U_1$–$U_{64}$, respectively, will be stored successively in the series of address areas corresponding to the designated channels N in RAM 6, starting at the top-leading address.

During the abovesaid write-in operation onto RAM 6, it should be noted that, in a comparator 9, there is being performed a comparison between time division multiplexed signals $TDM_1$ which are outputted from the respective pertinent setting units $U_i$ and time division multiplexed signals $TDM_2$ which are outputted from a terminal OUT of RAM 6, both of which group signals being in the same states respectively relative to each other. It should be noted also that, during said operation of write-in to RAM 6, the contents of data of the two group signals $TDM_1$ and $TDM_2$ in respective states are invariably in agreement with each other. Accordingly, during said write-in operation, the outputs of the terminal (A<B) and the terminal (A>B) will be "0," respectively, and the output of the terminal (A=B) will be "1."

Under the condition that the output delivered at the terminal (A=B) of the comparator 9 is "1," an AND gate 10 is disabled by the output "0" of an inverter 11. Accordingly, the input terminal S of RS flip-flop 12 (hereinafter to be referred to as RSFF) will always be "0." Also, an AND gate 13 is enabled only at the time of the 1st state shown in FIG. 4 to pass a clock pulse $\phi$ therethrough. Therefore, to an input terminal R of the RSFF 12 is inputted a pulse which is rendered "1" only for the period of time from the commencement of the 1st state up to the time that $\frac{1}{2}$ of the 1st state has lapsed. Accordingly, the RSFF 12 is maintained in its reset condition since the arrival of the 1st state, in response to the build-up (i.e. shift from "0" to "1") of such pulse. Thus, the Q output of RSFF 12 becomes "0," and the $\overline{Q}$ output thereof will become "1."

Also, an AND gate 14 is enabled only in the 64th state shown in FIG. 4 to let the clock pulse $\overline{\phi}$ pass therethrough. Accordingly, to an input terminal T of a JK flip-flop 15 (hereinafter to be referred to as JKFF) is inputted such pulse as will become "1" only for the length of time from the time that ½ of the 64th state has lapsed up to the termination of this 64th state. Accordingly, JKFF 15 will output after its reading-in of both the Q output and the $\overline{Q}$ output of RSFF 12 at the time of termination of the 64th state which occurs in response to the decay (i.e. from "1" to "0") of said pulse. As a result, after the termination of the 64th state, the Q output of JKFF 15 is held at "0," and the $\overline{Q}$ output thereof is kept at "1."

The $\overline{Q}$ output of JKFF 15 is supplied, as a display enabling signal, to an indicator DPY after passing through an OR gate 16. Also, to this indicator DPY is supplied, as a display data DD, an output of the register 8. Accordingly, it will be noted that, when all of the outputs (A=B) of the comparator 9 become "1" in all of the states, and when, accordingly, the $\overline{Q}$ output of JKFF 15 is rendered "1", there is displayed on the indicator DPY the number of the then designated memory channel (e.g. 12th channel).

On the other hand, to an input terminal S of RSFF 17 is supplied an output of the OR gate 7, and to an input terminal R thereof is supplied a $\overline{Q}$ output of JKFF 15. Also, the Q output of RSFF 17 is supplied to a terminal SA of a selector 20 via an AND gate 18 and an inverter 19 which are controlled by the Q output of JKFF 15. Accordingly, as stated above, when the output (A=B) of the comparator 9 becomes "1" in all of the states, and when, accordingly, the Q output of JKFF 15 becomes "0," the AND gate 18 is disabled, and accordingly, the output of the terminal SA of the selector 20 will be rendered "1." As a result, in the selector 20, its terminal A is selected, so that there are outputted, from the selector 20, time division multiplexed signals $TDM_1$ which are the signals supplied from the respective setting units $U_1$–$U_{64}$. These signals $TDM_1$ are supplied to a register group 21.

To respective registers $Rg_1$–$Rg_{64}$ which jointly constitute this register group 21 are being supplied with timing signals $TL_1$–$TL_{64}$, respectively. Accordingly, these respective registers $Rg_1$–$Rg_{64}$ are loaded with data $SD_1$–$SD_{64}$, respectively, which indicate the contents set on respective setting units $U_1$–$U_{64}$. And, the outputs of the respective registers $Rg_1$–$Rg_{64}$ are supplied to a tone generator section 23 of the electronic musical instrument. Whereby, there is performed a desired tone control in accordance with the contents set on the respective setting members $SS_1$–$SS_{64}$ of the setting units $U_1$–$U_{64}$. Reference numeral 24 represents a keyboard, and 25 represents a D/A converter for converting digital outputs of the tone generator section 23 to analog signals and for delivering the latter signals to a sound system 26.

Also, throughout the period in which write-in operation to RAM 6 is being performed, the output of the AND gate 18 is inverted by the inverter 22 and is supplied, as a clutch controlling signal CH, to registers $RG_1$–$RG_{64}$ provided in the setting units $U_1$–$U_{64}$, respectively, whereby the clutch controlling signal CH "1" is loaded on the respective registers $RG_1$–$RG_{64}$. Accordingly, respective clutches $CR_1$–$CR_{64}$ is rendered to their released condition. Thus, it does not happen that the contents set on the respective setting members $SS_1$–$SS_{64}$ are altered by motors $M_1$–$M_{64}$.

Description will next be made of the instance wherein the respective setting members $SS_1$–$SS_{64}$ are shifted of their conditions from the conditions that they are set to arbitrary contents over to predetermined contents which have preliminarily been stored in predetermined channels of RAM 6.

In case, as stated above, there is established an agreement, in all of the states, between the time division multiplexed signals $TDM_1$ which are outputted from respective setting members $SS_1$–$SS_{64}$ of respective setting units $U_1$–$U_{64}$ and those time division multiplexed signals $TDM_2$ which are outputted from RAM 6, the Q output of JKFF 15 will become "0," and its $\overline{Q}$ output will become "1," so that the ANd gate 18 is disabled, and accordingly RSFF 17 is reset so that its Q output becomes "0." On the other hand, in case there is a disagreement between these two groups of signals $TDM_1$ and $TDM_2$, it will be noted that, even when the Q output of JKFF 15 becomes "1," RSFF 17 remains in its reset condition. Therefore, the Q output thereof will be held at "0." By this Q output also, the AND gate 18 is disabled in the same way. Accordingly, unless either one of the channel-designating switches $CS_1$–$CS_{16}$ is freshly "made," signal "1" will be continuously supplied to the terminal SA of the selector 20. Whereby, data from the respective setting members $SS_1$–$SS_{64}$ will be kept being supplied to the tone generator section 23.

Let us now assume that a channel-designating switch $CS_N$ corresponding to a desired memory channel N is depressed in the abovesaid condition of the musical instrument. Whereupon, in a manner same as that for the abovesaid write-in operation, respective addresses in the address areas corresponding to the designated channels N are designated successively starting at the top-leading one. Also, since, at such time, the output of the write-in switch WS is "0," the output of the terminal $W/\overline{R}$ of RAM 6 becomes "0," and accordingly RAM 6 is set to the read-out mode. As a result, from this RAM 6 are outputted time division multiplexed signals $TDM_2$ which are signals that express, by the outputs of respective encoders $EC_1$–$EC_{16}$, the contents set on respective setting members $SS_1$–$SS_{64}$. And, these signals $TDM_2$ which indicate the abovesaid freshly set contents are compared, in the comparator 9, with the signals $TDM_1$ which indicate the currently set contents.

In case, as a result of comparison, the currently set data $SD_i$ in the signals $TDM_1$ are found to be smaller than the freshly set data $SD_i$ in the signals $TDM_2$, only the output of the terminal (A<B) of the comparator 9 is rendered "1" in the then state $ST_i$. In case, conversely, the currently set data $SD_i$ in the signals $TDM_1$ are found to be greater than the freshly set data $SD_i$ in the signals $TDM_2$, only the output at the terminal (A>B) of the comparator 9 will become "1" in said state $ST_i$. Furthermore, in case the two are equal with each other, only the output of the terminal (A=B) will become "1" in said state $ST_i$. And, the outputs of the respective terminal (A<B) and (A>B) in the respective states $ST_i$ are loaded successively on respective registers $RG_i$ in the concerned setting unit $U_i$. In case there is disagreement between the current set data $SD_i$ and the freshly set data $SD_i$ in either one state $ST_i$ among the 1st to 64th states, the RSFF 12 is unfailingly set at the time at which ½ of the disagreement-constituting state $ST_i$ has lapsed. In response thereto, the Q output of JKFF 15 will become "1" at the time of termination of the 64th state. Furthermore, when the channel-designating switch $CS_N$ is "made" as described above, the Q output of RSFF 17 will become "1" at the moment that said switch $CS_N$ is "made," by virtue of the output of the OR gate 7. Accordingly, during the period of time from the time the channel operating button $CB_N$ is depressed up to the time at which the respective setting members $SS_1$–$SS_{64}$ are perfectly set to the conditions corresponding to the respective set data $SD_i$ which are read out from RAM 6 as stated above, the output of the AND gate 18 will remain to be "1." And, this output "1" is inverted to "0" by the inverter 22, and then it is supplied, as a clutch controlling signal CH, to the registers $RG_i$ in the respective setting units $U_i$, and loaded on said registers $RG_i$ at a predetermined timing $TL_i$.

Accordingly, within the respective setting units $U_i$, clutches $CR_i$ are connected upon its receipt of the clutch controlling signal CH "0." Concurrently therewith, the gates $G_i$ are enabled so that the signals $(A<B)_i$ and $(A>B)_i$ are supplied to the motors $M_i$. Thus, respective setting members $SS_i$ will be driven toward making compensation for the deviation existing between the current set data $SD_i$ and the freshly set data $SD_i$.

On the other hand, as discussed above, during the period of time from the moment that the channel operating button $CB_N$ is depressed up to the time at which the respective setting members $SS_1$–$SS_{64}$ are perfectly set to the conditions corresponding to the respective set data $SD_i$ which are read out from RAM 6, the output of the AND gate 18 remains to be "1." This output "1" is supplied to the terminal SA of the selector 20 after being inverted by the inverter 19. Accordingly, at the same time that either one $CB_N$ of the channel operating buttons is depressed, the terminal B is selected in the selector 20. Thus, the time division multiplexed signals which are supplied to the register group 21 will be instantaneously shifted from $TDM_1$ which indicates the current contents set on respective setting members over to $TDM_2$ which indicates freshly set contents. As a result, even when a relatively lengthy time, e.g. 0.5–1 second, is required from the time that a desired memory channel is read out from RAM 6 up to the time that respective setting members $SS_1$–$SS_{64}$ are completely set to the read-out contents, there will be supplied to the tone generator section 23 new controlling data $TDM_2$ ($SD_1'$, $SD_2'$, . . . , $SD_{64}'$) at the same time that the memory channel is recalled. As a result, at any moment in the midst of play of the electronic musical instrument, it is possible for the player to perform quick automatic setting of such tone quality patterns as tone effect and tone color.

On the other hand, when respective setting members $SS_1$–$SS_{64}$ are completely set to the contents which are read out from RAM 6, the output $(A>B)$ and the output $(A<B)$ of the comparator 9 will become "0" in all of the states. Conversely, the output $(A=B)$ will become "1" in all of the states. As a result, at the termination of the 64th state, the output of JKFF 15 will be shifted from "0" to "1." In response to this build-up of the signal, RSFF 17 is reset. Accordingly, the AND gate 18, upon its receipt of Q output "0" of RSFF 17, will be kept in its disabled condition. This disabled condition continues until either one of the channel designating switches CS is depressed anew.

As stated above, when the AND gate 18 is disabled, there is supplied a signal "1" to the terminal SA of the selector 20. And, in the selector 20, the terminal A is selected. Accordingly, respective setting members $SS_1$–$SS_{64}$ are completely set to the freshly set contents. Concurrently therewith, the signal which is supplied to the tone generator section 23 is switched from $TDM_2$ which is outputted from RAM 6, over to $TDM_1$ which is outputted from respective setting members $SS_1$–$SS_{64}$. Subsequently therefrom, the tone generator section 23 will be controlled by the signal $TDM_1$ supplied from respective setting members $SS_1$–$SS_{64}$.

On the other hand, during the period of time till the above setting completes, the indicator DPY remains to be enabled by the output "1" of the AND gate 18. Also, once the said setting has completed, the indicator DPY is controlled by the $\overline{Q}$ output "1" of JKFF 15. Accordingly, the indicator will continuously display the designated memory channel number, regardless of being before or after the completion of setting.

Description will next be made of the instance wherein, after the abovesaid automatic setting has completed, the set condition is altered or modified by an operation of a manipulating lever $LV_i$.

When, due to the operation of the manipulating lever $LV_i$, the data $SD_i$ showing the set condition of the setting member $SS_i$ corresponding to said operated manipulating lever $LV_i$ comes into disagreement with the data $SD_i$ of the setting member $SS_i$ outputted from RAM 6, the output $(A=B)$ of the comparator 9 becomes "0" in the state $ST_i$ corresponding to said setting member $SS_i$, and following the above-stated sequential course, the $\overline{Q}$ output of JKFF 15 will become "0" subsequent to the time of termination of the 64th state. As a result, the value of the enabling signal which is supplied to the indicator DPY becomes "0," so that the indicator DPY turns its illumination off. Whereby, it is possible for the player to visually acknowledge the fact that the current contents of the respective setting members $SS_i$ differ from the set contents read out from RAM 6.

On the other hand, when the output $(A=B)$ of the comparator 9 becomes "0" in either one of the states $ST_i$, the Q output of JKFF 15 will become "1" subsequent to the time of termination of the 64th state. In this condition, however, the Q output of RSFF 17 is "0," so that the Q output "1" of JKFF 15 is disabled by the AND gate 18, and accordingly, the signal condition at the terminal SA of the selector 20 will not be altered. Accordingly, in case, as stated previously, the contents of either one of the setting members $SS_i$ are altered or modified by operating a manipulating lever $LV_i$, there will be supplied to the tone generator section 23 a new set data of post-alteration or post-modification.

Thus, according to the tone quality presetting apparatus of the instant embodiment, respective setting members $SS_1$–$SS_{64}$ are set to desired contents by operating the manipulating levers $LV_1$–$LV_{64}$, and thereafter the write-in button WB and also an operating button CB corresponding to the desired memory channel are depressed. Whereupon, the number of the designated channel is displayed on the indicator DPY. Concurrently therewith, in that address area in RAM 6 corresponding to said memory channel, there will be stored successively those data $SD_1$–$SD_{64}$ indicating the contents set on the respective setting members $SS_1$–$SS_{64}$, starting with the top-leading address. In other words, it is possible to write desired data in RAM 6 by an operation of ordinary manipulating lever $LV_1$–$LV_{64}$ without requiring any special and exclusively designed operating means.

Also, after the abovesaid write-in operation, operating button $CB_N$ corresponding to a desired memory channel may be depressed. Whereupon, respective motors $M_1$–$M_{64}$ will be driven in correspondence to the respective set data $SD_1$–$SD_{64}$ which are outputted from RAM 6. Whereby, respective setting members $SS_1$–$SS_{64}$ are automatically set to the contents which are indicated by the respective set data $SD_1$–$SD_{64}$ within a length of time of, for example, 0.5–1 second. On the other hand, during the period of time from the time at which an operating button $CB_N$ is depressed up to the completion of setting by respective setting members $SS_1$–$SS_{64}$, new set data $SD_1$–$SD_{64}$ which are read out from RAM 6 are now supplied to the tone generator section, in place of the set data $SD_1$–$SD_{64}$ supplied from the respective setting members. As such, even when noises are generated from respective setting members $SS_1$–$SS_{64}$ which are still in their setting mode, such noises will never be supplied to the tone generator section 23. Also, from the very moment that an operating button $CB_N$ is depressed, new set data $SD_1$–$SD_{64}$ are supplied to the tone generator section 23. Therefore, it becomes unnecessary to employ large capacity motors for driving respective setting members at a high speed, which, however, was necessary in conventional tone quality presetting apparatuses. Thus, power dissipation can be greatly reduced.

Also, once automatic setting has been completed, the tone generator section will thereafter be controlled by the set data $SD_1$–$SD_{64}$ supplied from the respective setting members $SS_1$–$SS_{64}$. Therefore, subsequent therefrom, a manipulating lever $LV_1$–$LV_{64}$ may be operated so that the set contents of respective setting members $SS_1$–$SS_{64}$ will be altered or modified. Whereupon, the tone generator section will then be controlled in accordance with the altered or modified set data. In other words, it becomes possible for the player to effect any arbitrary alteration or modification of the set data even after the completion of automatic setting of contents.

On the other hand, when an operating button $CB_N$ corresponding to either one of the memory channels is depressed, there is displayed the number of the designated memory channel on the indicator DPY. Concurrently, this display will become extinguished if the player operates a manipulating lever $LV_1$–$LV_{64}$ to alter or modify the set contents of either one of the setting members $SS_i$. Accordingly, based on this display, the player is able to confirm whether the currently set contents of the setting members $SS_1$–$SS_{64}$ are those which have been automatically set or manually set.

What is claimed is:

1. A tone quality presetting apparatus for use in an electronic musical instrument having a tone generator section comprising:

a plurality of tone quality pattern setting means for setting tone quality patterns such as tone color and effect, each setting means being selectively driven by manual operating means or powered driving means to set values on said setting means;

memory means having a plurality of memory addresses and address-designating means, for storing in said memory addresses data representing said values set on said setting means, and being adapted to be recalled to said data stored in said memory addresses designated by said address-designation means to cause such data to be read out from said memory means, the read-out data actuating said driving means to set said setting means according to the read-out data;

selecting means for selecting either said data representing said values set on said setting means or the data read out from said memory means, and for delivering the selected one to said tone generator section; and controlling means for causing, when said memory means is recalled and before said driving means has set said setting means according to the data read out from said memory means, said selecting means to select for delivery to said tone generator section the data read out from said memory means, and for causing, when said driving means has set said setting means according to the data read out from said memory means, said selecting means thereafter to select for delivery to said tone generator section data representing said values set on said setting means.

2. A tone quality presetting apparatus according to claim 1, further comprising:

comparing means for comparing said data representing said values set on said setting means with the data read out from said memory means, and wherein;

said controlling means causes, in cooperation with said comparing means, said selecting means to select the read-out data from said memory means when said comparing means detects a difference between the compared data and to select the data representing said values set on said setting means when said comparing means detects coincidence between the compared data.

3. A tone quality presetting apparatus according to claim 2, in which said setting means is directly coupled to said manual operating means and, via clutch means, to said powered driving means.

4. A tone quality presetting apparatus according to claim 3, in which said clutch means couples, while said comparing means detects a difference between the compared data, said powered driving means to said setting means.

5. A tone quality presetting apparatus according to claim 3 in which said clutch means couples, while said controlling means causes said selecting means to select the read-out data from said memory means, said powered driving means to said setting means.

6. A tone quality presetting apparatus according to claim 2, further comprising:

indicating means for performing a display, while coincidence is detected by said comparing means, of the designated memory address of said memory means, and for extinguishing said display when a difference is detected by said comparing means.

7. A tone quality presetting apparatus according to claim 6, in which said comparing means is inputted with two groups of data to be compared, each being provided in the form of time division multiplexed signals having time slots corresponding to the number of said setting means, and compares said two groups of time division multiplexed signals in their respective corresponding time slots.

8. A tone quality presetting apparatus according to claim 7, in which said controlling means causes said indicating means to display memory addresses when said comparing means continues to detect coincidence for a period of time from a time-divided first time slot up to a final time slot.

9. A tone quality presetting apparatus according to claim 7, in which said controlling means extinguishes the display of the memory address on said indicating means when at least one difference is detected by said comparing means during the period from said time-divided first to final time slots.

10. A tone quality presetting apparatus according to claim 7, further comprising:

a first flip-flop that is reset at the time of a time-divided first time slot and is set upon detection of a difference by said comparing means;

a second flip-flop that is inputted with an output of said first flip-flop at the time of a time-divided final time slot and which holds the contents of said output, an output of said second flip-flop controlling said indicating means; and a third flip-flop for delivering, upon its receipt of an output of said second flip-flop and an output from said address-designating means, an output for controlling said indicating means and said selecting means.

11. A tone quality presetting apparatus for use in an electronic musical instrument having a tone generator section, comprising:

a plurality of tone quality setting units, each unit having a power driven setting member and providing output data indicative of the value to which said member is set, a memory for storing at least one set of data representing desired settings of said setting members, readout means, operative upon selection of a readout condition, for reading out from said memory a selected set of data and for supplying the same to said tone quality setting unit so as to cause said power driven setting members to be reset to values corresponding to said read out set of data, and selection means, operative when said readout condition is selected, for immediately supplying said set of data read out from said memory to said tone generator section to control the tone quality thereof during the time that said power driven setting members are being reset, and for supplying to said tone generator means the output data directly from said tone quality setting units once each power driven setting member has reached a value corresponding to that of the read out data, whereby the tone quality of said tone generator section is switched immediately to the memory-stored preset value when a readout condition is selected, without delay or erroneous tone quality production while said power driven setting members are being reset.

* * * * *